US006564718B2

(12) United States Patent
Reese et al.

(10) Patent No.: US 6,564,718 B2
(45) Date of Patent: May 20, 2003

(54) LEAD FREE LINER COMPOSITION FOR SHAPED CHARGES

(75) Inventors: James W. Reese, Spring, TX (US); Steve Henderson, Katy, TX (US); William Harvey, Indian Head, MD (US); Terry Slagle, Cypress, TX (US)

(73) Assignee: Baker Hughes, Incorporated, Houston, TX (US)

( * ) Notice: Subject to any disclaimer, the term of this patent is extended or adjusted under 35 U.S.C. 154(b) by 0 days.

(21) Appl. No.: 09/860,116

(22) Filed: May 17, 2001

(65) Prior Publication Data

US 2002/0007754 A1 Jan. 24, 2002

Related U.S. Application Data

(60) Provisional application No. 60/206,098, filed on May 20, 2000.

(51) Int. Cl.[7] ..... F42B 1/032
(52) U.S. Cl. ..... 102/307; 102/476
(58) Field of Search ..... 102/306, 307, 102/476

(56) References Cited

U.S. PATENT DOCUMENTS

| | | | | | |
|---|---|---|---|---|---|
| 3,375,108 | A | | 3/1968 | Wyman, Sr. et al. | 75/202 |
| 3,388,663 | A | | 6/1968 | Wyman, Sr. et al. | 102/24 |
| 4,498,367 | A | | 2/1985 | Skolnick et al. | 102/306 X |
| 4,613,370 | A | | 9/1986 | Held et al. | 102/306 X |
| 4,766,813 | A | | 8/1988 | Winter et al. | 102/307 |
| 4,836,108 | A | * | 6/1989 | Kegel et al. | 102/476 X |
| 4,858,531 | A | * | 8/1989 | Lindstadt et al. | 102/476 X |
| 4,976,203 | A | | 12/1990 | Weisshaupt et al. | 102/476 |
| 5,098,487 | A | * | 3/1992 | Brauer et al. | 102/476 X |
| 5,119,729 | A | * | 6/1992 | Nguyen | 102/476 X |
| 5,221,808 | A | | 6/1993 | Werner et al. | 102/307 |
| 5,279,228 | A | | 1/1994 | Ayer | 102/306 |
| 5,413,048 | A | | 5/1995 | Werner et al. | 102/307 |
| 5,567,906 | A | | 10/1996 | Reese et al. | 102/307 |
| 5,597,974 | A | * | 1/1997 | Voreck, Jr. et al. | 102/307 |
| 5,656,791 | A | | 8/1997 | Reese et al. | 102/307 |
| 5,698,814 | A | * | 12/1997 | Parsons et al. | 102/307 X |
| 5,753,850 | A | * | 5/1998 | Chawla et al. | 102/476 X |
| 5,760,331 | A | * | 6/1998 | Lowden et al. | 102/506 |
| 5,814,758 | A | | 9/1998 | Leidel | 102/307 |
| 5,939,664 | A | * | 8/1999 | Kapoor | 102/307 X |
| 6,012,392 | A | * | 1/2000 | Norman et al. | 102/307 |

* cited by examiner

*Primary Examiner*—Peter A. Nelson
(74) *Attorney, Agent, or Firm*—Darryl M. Springs; Keith R. Derrington

(57) ABSTRACT

A liner for a shaped charge formed from a mixture of powdered heavy metal and a powdered metal binder. The liner is formed by compression of the mixture into a liner body shape. In the preferred embodiment of the invention, the mixture comprises a range of 90 to 97 percent by weight of powdered heavy metal, and 10 to 3 percent by weight of the powdered metal binder. In a specific embodiment of the invention, a lubricant is intermixed with the powdered metal binder to aid in the formation of the shaped charge liner. The preferred powdered heavy metal is tungsten, and the preferred powdered metal binder is copper. The powdered metal binder can be comprised of other malleable ductile metals such as bismuth, zinc, tin, uranium, silver, gold, antimony, cobalt, zinc alloys, tin alloys, nickel, or palladium.

22 Claims, 1 Drawing Sheet

LEAD FREE LINER COMPOSITION FOR SHAPED CHARGES

RELATED APPLICATIONS

This application claims priority from co-pending U.S. Provisional Application No. 60/206098, filed May 20, 2000, the full disclosure of which is hereby incorporated by reference herein.

BACKGROUND OF THE INVENTION

1. Field of the Invention

The invention relates generally to the field of explosive shaped charges. More specifically, the present invention relates to a composition of matter for use as a liner in a shaped charge, particularly a shaped charge used for oil well perforating.

2. Description of Related Art

Shaped charges are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Shaped charges known in the art for perforating wellbores are used in conjunction with a perforation gun and the shaped charges typically include a housing, a liner, and a quantity of high explosive inserted between the liner and the housing where the high explosive is usually HMX, RDX PYX, or HNS. When the high explosive is detonated, the force of the detonation collapses the liner and ejects it from one end of the charge at very high velocity in a pattern called a "jet". The jet penetrates the casing, the cement and a quantity of the formation. The quantity of the formation which may be penetrated by the jet can be estimated for a particular design shaped charge by test detonation of a similar shaped charge under standardized conditions. The test includes using a long cement "target" through which the jet partially penetrates. The depth of jet penetration through the specification target for any particular type of shaped charge relates to the depth of jet penetration of the particular perforation gun system through an earth formation.

In order to provide perforations which have efficient hydraulic communication with the formation, it is known in the art to design shaped charges in various ways to provide a jet which can penetrate a large quantity of formation, the quantity usually referred to as the "penetration depth" of the perforation. One method known in the art for increasing the penetration depth is to increase the quantity of explosive provided within the housing. A drawback to increasing the quantity of explosive is that some of the energy of the detonation is expended in directions other than the direction in which the jet is expelled from the housing. As the quantity of explosive is increased, therefore, it is possible to increase the amount of detonation-caused damage to the wellbore and to equipment used to transport the shaped charge to the depth within the wellbore at which the perforation is to be made.

The sound speed of a shaped charge liner is the theoretical maximum speed that the liner can travel and still form a coherent "jet". If the liner is collapsed at a speed that exceeds the sound speed of the liner material the resulting jet will not be coherent. The sound speed of a liner material is calculated by the following equation, sound speed=(bulk modulus/density)$^{1/2}$ (Equation 1.1). A coherent jet is a jet that consists of a continuous stream of small particles. A non-coherent jet contains large particles or is a jet comprised of multiples streams of particles. Increasing the collapse speed of the liner will in turn increase jet tip speeds. Increased jet tip speeds are desired since an increase in jet tip speed increases the kinetic energy of the jet which in turn provides increased well bore penetration. Therefore, a liner made of a material having a higher sound speed is preferred because this provides for increased collapse speeds while maintaining jet coherency.

Accordingly, it is important to supply a detonation charge to the shaped charge liner that does not cause the shaped charge liner to exceed its sound speed. On the other hand, to maximize penetration depth, it is desired to operate shaped charge liners at close to their sound speed and to utilize shaped charge liners having maximum sound speeds. Furthermore, it is important to produce a jet stream that is coherent because penetration depth of coherent jet streams is greater than the penetration depth of non-coherent jet streams.

As per Equation 1.1 adjusting the physical properties of the shaped charge liner materials can affect the sound speed of the resulting jet. Furthermore, the physical properties of the shaped charge liner material can be adjusted to increase the sound speed of the shaped charge liner, which in turn increases the maximum allowable speed to form a coherent jet. Knowing the sound speed of a shaped charge liner is important since theoretically a shaped charge liner will not form a coherent jet if the jet speed well exceeds the sound speed of the shaped charge liner.

It is also known in the art to design the shape of the liner in various ways so as to maximize the penetration depth of the shaped charge for any particular quantity of explosive. Even if the shape and sound speed of the shaped charge liner is optimized, the amount of energy which can be transferred to the liner for making the perforation is necessarily limited by the quantity of explosive.

Shaped charge performance is dependent on other properties of the liner material. Density and ductility are properties that affect the shaped charge performance. Optimal performance of a shaped charge liner occurs when the jet formed by the shaped charge liner is long, coherent and highly dense. The density of the jet can be controlled by utilizing a high density liner material. Jet length is determined by jet tip velocity and the jet velocity gradient. The jet velocity gradient is the rate at which the velocity of the jet changes along the length of the jet whereas the jet tip velocity is the velocity of the jet tip. The jet tip velocity and jet velocity gradient are controlled by liner material and geometry. The higher the jet tip velocity and the jet velocity gradient the longer the jet. In solid liners, a ductile material is desired since the solid liner can stretch into a longer jet before the velocity gradient causes the liner to begin fragmenting. In porous liners, it is desirable to have the liner form a long, dense, continuous stream of small particles. To produce a coherent jet, either from a solid liner or a porous liner; the liner material must be such that the liner does not splinter into large fragments after detonation.

The solid shaped charge liners are formed by cold working a metal into the desired shape, others are formed by adding a coating onto the cold formed liner to produce a composite liner. Information relevant to cold worked liners is addressed in Winter et al., U.S. Pat. No. 4,766,813, Ayer U.S. Pat. No. 5,279,228, and Skolnick et al., U.S. Pat. No. 4,498,367. However, solid liners suffer from the disadvantage of allowing "carrots" to form and become lodged in the resulting perforation—which reduces the hydrocarbon flow from the producing zone into the wellbore. Carrots are sections of the shaped charge liner that form into solid slugs after the liner has been detonated and do not become part of the shaped charge jet. Instead the carrots, which can take on an oval shape, travel at a velocity that is lower than the shaped charge jet velocity and thus trail the shaped charge jet.

Porous liners are formed by compressing powdered metal into the desired liner shape. Traditional liner shapes are conical, linear, and hemispherical. Typically, the liners that have been formed by compressing powdered metals have utilized a composite of two or more different metals, where at least one of the powdered metals is a heavy or higher density metal, and at least one of the powdered metals acts as a binder or matrix to bind the heavy or higher density metal. Examples of heavy or higher density metals used in the past to form liners for shaped charges have included tungsten, hafnium, copper, or bismuth. Typically the binders or matrix metals used comprise powdered lead, however powdered bismuth has been used as a binder or matrix metal. While lead and bismuth are more typically used as the binder or matrix material for the powdered metal binder, other metals having high ductility and malleability can be used for the binder or matrix metal. Other metals which have high ductility and malleability and are suitable for use as a binder or matrix metal comprise zinc, tin, uranium, silver, gold, antimony, cobalt, copper, zinc alloys, tin alloys, nickel, and palladium. Information relevant to shaped charge liners formed with powdered metals is addressed in Werner et al., U.S. Pat. No. 5,221,808, Werner et al., U.S. Pat. No. 5,413,048, Leidel, U.S. Pat. No. 5,814,758, Held et al. U.S. Pat. No. 4,613,370, Reese et al., U.S. Pat. No. 5,656,791, and Reese et al., U.S. Pat. No. 5,567,906.

However, each one of the aforementioned references related to powdered metal liners suffer from the disadvantages of liner creep, and/or a high percentage of binder material in the material mix. Liner creep involves the shaped charge liner slightly expanding after the shaped charge has been assembled and stored. Slight expansion of the shaped charge liner reduces shaped charge effectiveness and repeatability.

The binder or matrix material typically has a lower density than the heavy metal component. Accordingly the overall density of the shaped charge liner is reduced when a significant percentage of the shaped charge liner is comprised of the binder or matrix material. Reducing the overall density of the shaped charge liner reduces the penetration depth produced by the particular shaped charge.

Therefore, it is desired to produce a shaped charge liner that is not subject to creep, has an improved overall density, and a high sound speed.

BRIEF SUMMARY OF THE INVENTION

The present invention solves a number of the problems inherent in the prior art by providing a liner for a shaped charge comprising a mixture of powdered tungsten and powdered metal binder wherein the tungsten powder comprises from 90 percent by weight of the mixture to 97 percent by weight of the mixture. The powdered metal binder comprises from 10 percent by weight of the mixture to 3 percent by weight of the mixture. The liner for a shaped charge is formed by compressing the mixture into a liner body shape, where the shape can be chosen from the group consisting of conical, bi-conical, tulip, circumferential, hemispherical, linear or trumpet. The liner for a shaped charge further comprises a lubricant such as powdered graphite or oil intermixed with the tungsten and the powdered metal binder. While the preferred powdered metal binder is copper, the powdered metal binder can also consist of bismuth, zinc, tin, uranium, silver, gold, antimony, cobalt, zinc alloys, tin alloys, nickel, or palladium. Other and further features and advantages will be apparent from the following description of presently preferred embodiments of the invention given for the purpose of disclosure.

DETAILED DESCRIPTION OF THE INVENTION

Figure 1:
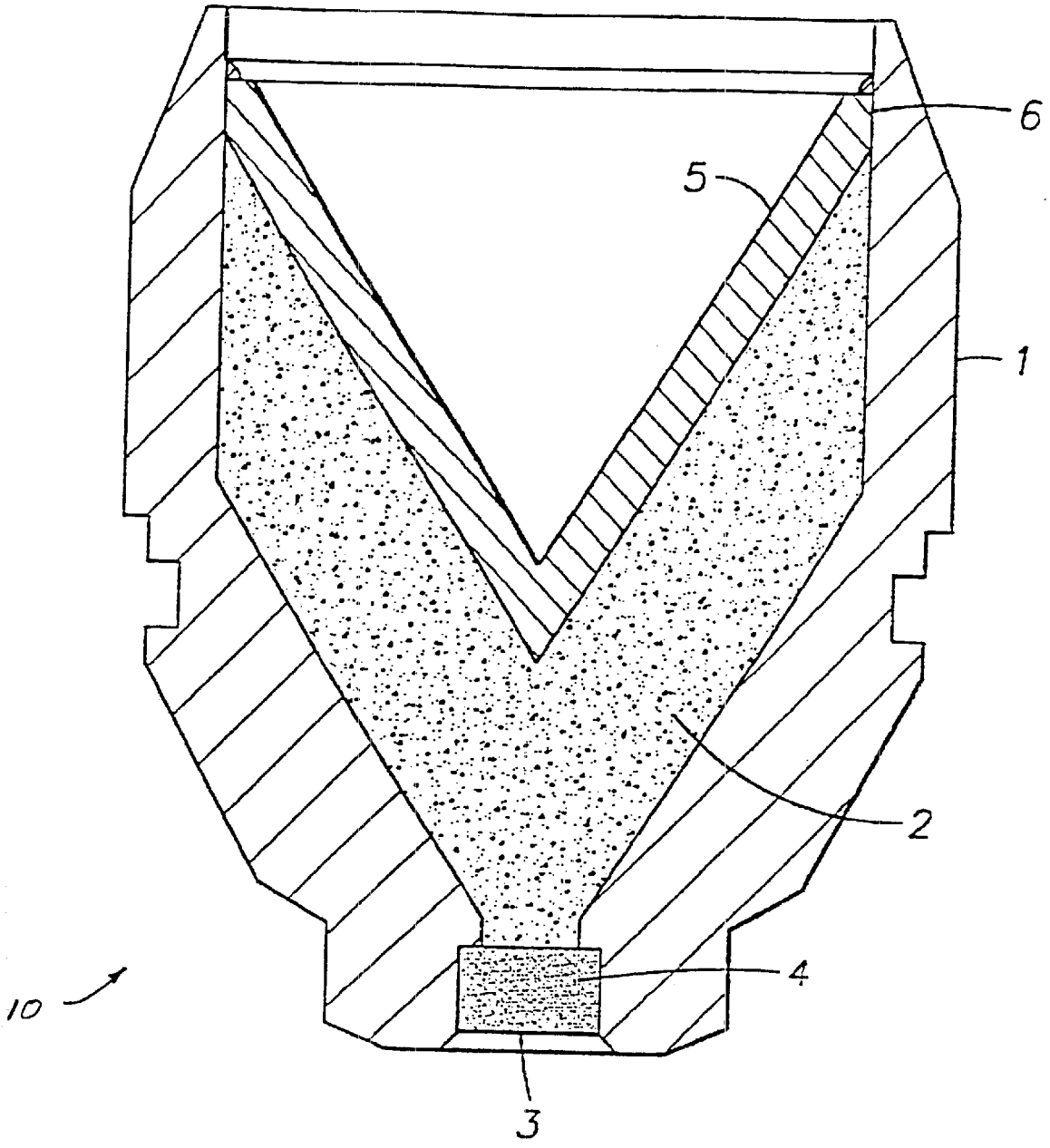
FIG. 1 depicts a cross-sectional view of a shaped charge with a liner according to the present invention.

In accordance with the present invention, a shaped charge 10 according to the invention is shown in FIG. 1. The shaped charge 10 typically includes a generally cylindrically shaped housing 1, which can be formed from steel, ceramic or other material known in the art. A quantity of high explosive powder, shown generally at 2, is inserted into the interior of the housing 1. The high explosive 2 can be of a composition known in the art. High explosives known in the art for use in shaped charges include compositions sold under trade designations HMX, HNS, RDX, HNIW, PYX and TNAZ. A recess 4 formed at the bottom of the housing 1 can contain a booster explosive (not shown) such as pure RDX. The booster explosive, as is understood by those skilled in the art, provides efficient transfer to the high explosive 2 of a detonating signal provided by a detonating cord (not shown) which is typically placed in contact with the exterior of the recess 4. The recess 4 can be externally covered with a seal, shown generally at 3.

A liner, shown at 5, is typically inserted on to the high explosive 2 far enough into the housing 1 so that the high explosive 2 substantially fills the volume between the housing 1 and the liner 5. The liner 5 of FIG. 1 is typically made from powdered metal which is pressed under very high pressure into a generally conically shaped rigid body. The conical body is typically open at the base and is hollow. Compressing the powdered metal under sufficient pressure can cause the powder to behave substantially as a solid mass. The process of compressively forming the liner from powdered metal is understood by those skilled in the art.

As will be appreciated by those skilled in the art, the liner 5 of the present invention is not limited to conical or frusto-conical shapes, but can be formed into numerous shapes. Additional liner shapes can include bi-conical, tulip, hemispherical, circumferential, linear, and trumpet.

As is further understood by those skilled in the art, when the explosive 2 is detonated, either directly by signal transfer from the detonating cord (not shown) or transfer through the booster explosive (not shown), the force of the detonation collapses the liner 5 and causes the liner 5 to be formed into a jet, once formed the jet is ejected from the housing 1 at very high velocity.

A novel aspect of the present invention is the composition of the powdered metal from which the liner 5 can be formed. The powdered metal mixture of the liner 5 of the present invention preferably consists of 95 percent by weight of a powdered heavy metal and 5 percent by weight of a powdered metal binder. The preferred powdered heavy metal is tungsten, however the powdered heavy metal can be any metal having acceptable acoustic wave conducting ability, such as depleted uranium, hafnium, tantalum, copper, or bismuth.

Optionally, lubricants such as graphite powder or oil can be added to the powdered metal mixture. The graphite powder can be added in an amount up to 1.0 percent by weight of the powdered metal mixture. The addition of the lubricant will weight for weight reduce the amount of powdered metal binder of the mixture. The lubricant aids the formation of the shaped charge liner during the forming process, as is understood by those skilled in the art. As will be further explained, the penetration depth of the shaped charge 10 is improved by using an increased percentage of powdered tungsten in the liner 5 material, compared with the depth of penetration achieved by shaped charges having liners of compositions known in the art which use lesser mass percentages of powdered tungsten.

The powdered metal binder can be comprised of the highly ductile or malleable metals selected from the group consisting of bismuth, zinc, tin, uranium, silver, gold, antimony, cobalt, copper, zinc alloys, tin alloys, nickel, copper, and palladium. However, the preferred powdered metal binder is powdered copper. Using copper as the powdered metal binder instead of the above noted powdered metal binders, especially with regard to lead, results in a shaped charge liner having a higher sound speed. As noted above, higher sound speeds are desired since higher jet speed results in an increased penetration depth.

Additionally, copper has a lower density than most of the other traditional binder metals, especially lead. A lower density powdered metal binder results in an increase in volume of the powdered metal binder. More powdered metal binder volume results in additional material that can act as a binder and thus better bind the heavy metal. A lower density powdered metal binder thus allows for a higher percentage of the heavy metal portion of the shaped charge liner, which in turn contributes to an increased overall sound speed of the shaped charge liner.

The specified amount of powdered metal binder in the liner mixture in the preferred composition of 5 percent by weight is not to be construed as an absolute limitation of the invention. A range of compositions of powdered metal mixture, including powdered tungsten up to 97 percent by weight and powdered metal binder of 3 percent by weight, down to powdered tungsten of 90 percent by weight and powdered metal binder to 10 percent by weight has been tested. It has been determined through this testing that mixture compositions within the specified range still provide effective shaped charge performance.

The liner 5 can be retained in the housing 1 by application of adhesive, shown at 6. The adhesive 6 enables the shaped charge 10 to withstand the shock and vibration typically encountered during handling and transportation without movement of the liner 5 or the explosive 2 within the housing 1. It is to be understood that the adhesive 6 is only used for retaining the liner 5 in position within the housing 1 and is not to be construed as a limitation on the invention.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A liner for a shaped charge comprising:

a mixture of powdered heavy metal and powdered metal binder wherein said powdered heavy metal comprises from 90 percent by weight of said mixture to 97 percent by weight of said mixture, and wherein said powdered metal binder comprises from 10 percent by weight of said mixture to 3 percent by weight of said mixture, said mixture compressively formed into a liner body shape by cold working under high pressure.

2. The liner for a shaped charge of claim 1 further comprising a lubricant intermixed with said tungsten and said powdered metal binder.

3. The liner for a shaped charge of claim 2, wherein said lubricant comprises powdered graphite.

4. The liner for a shaped charge of claim 2, wherein said lubricant comprises oil.

5. The liner for a shaped charge of claim 1 wherein said powdered metal binder is copper.

6. The liner for a shaped charge of claim 1 wherein said powdered heavy metal is tungsten.

7. The liner for a shaped charge of claim 1 wherein said powdered metal binder is selected from the group consisting of bismuth, zinc, tin, uranium, silver, gold, antimony, cobalt, zinc alloys, tin alloys, nickel, and palladium.

8. The liner for a shaped charge of claim 1, wherein said liner body shape is selected from the group consisting of conical, bi-conical, tulip, hemispherical, circumferential, linear, and trumpet.

9. A shaped charge comprising:

a housing;

a quantity of explosive inserted into said housing; and a liner inserted into said housing so that said quantity of explosive is positioned between said liner and said housing, said liner formed from a mixture of powdered tungsten and powdered metal binder, wherein said powdered heavy metal comprises from 90 percent by weight of said mixture to 97 percent by weight of said mixture, and wherein said powdered metal binder comprises from 10 percent by weight of said mixture to 3 percent by weight of said mixture, said mixture compressively formed into a liner body shape by cold working under sufficient pressure to cause powders to behave substantially as a solid mass.

10. The liner for a shaped charge of claim 9 further comprising a lubricant intermixed with said tungsten and said powdered metal binder.

11. The liner for a shaped charge of claim 10, wherein said lubricant comprises powdered graphite.

12. The liner for a shaped charge of claim 10, wherein said lubricant comprises oil.

13. The liner for a shaped charge of claim 9 wherein said powdered heavy metal is tungsten.

14. The liner for a shaped charge of claim 9 wherein said powdered metal binder is copper.

15. The shaped charge of claim 9 further comprising a booster explosive disposed in said housing and in contact with said quantity of explosive, said booster explosive for transferring a detonating signal from a detonating cord in contact with the exterior of said housing to said high explosive.

16. The liner for a shaped charge of claim 9, wherein said liner body shape is selected from the group consisting of conical, bi-conical, tulip, hemispherical, circumferential, linear, and trumpet.

17. The shaped charge of claim 9 wherein said quantity of explosive comprises RDX.

18. The shaped charge of claim 9 wherein said quantity of explosive comprises HMX.

19. The shaped charge of claim 9 wherein said quantity of explosive comprises HNS.

20. The shaped charge of claim 9 wherein said quantity of explosive comprises HNIW.

21. The shaped charge of claim 9 wherein said quantity of explosive comprises TNAZ.

22. The shaped charge of claim 9 wherein said quantity of explosive comprises PYX.

* * * * *